US005269213A

United States Patent [19]

Coneski et al.

[11] Patent Number: 5,269,213

[45] Date of Patent: Dec. 14, 1993

[54] PUNCH APPARATUS

[75] Inventors: Anthony F. Coneski, Newburgh, N.Y.; Douglas J. Sykora, Amery, Wis.; Mitchel Waian, Wappingers Falls, N.Y.

[73] Assignee: International Business Machines Corporation, Armonk, N.Y.

[21] Appl. No.: 16,670

[22] Filed: Feb. 11, 1993

Related U.S. Application Data

[63] Continuation of Ser. No. 846,499, Feb. 25, 1992, abandoned.

[51] Int. Cl.[5] ..... B26F 1/02

[52] U.S. Cl. ..... 83/577; 83/588; 83/616

[58] Field of Search ..... 83/575, 577, 588, 616, 83/686; 173/210

[56] References Cited

U.S. PATENT DOCUMENTS

| | | | |
|---|---|---|---|
| 1,138,804 | 5/1915 | Simmen | 83/577 |
| 1,152,522 | 9/1915 | Leidigh | 83/577 |
| 1,671,369 | 5/1928 | Johann | 83/575 |
| 1,684,296 | 12/1925 | Brodsky | 192/134 |
| 2,509,956 | 5/1950 | Benoit | 83/577 |
| 2,597,559 | 5/1952 | Bekey | 361/155 |
| 3,008,365 | 11/1961 | McNabb, Jr. | 83/575 |
| 3,388,753 | 6/1968 | Bardwell | 173/210 |
| 3,709,083 | 1/1973 | Doherty | 83/575 |
| 3,841,185 | 10/1974 | Baran | 83/364 |
| 3,878,746 | 4/1975 | Carmelli | 83/623 X |
| 4,579,029 | 4/1986 | Sunaga | 83/364 |
| 5,024,127 | 6/1991 | Mueller et al. | 83/13 |

OTHER PUBLICATIONS

IBM Technical Disclosure Bulletin, vo. 20, No. 4, Sep. 1977 "Automated Punch Apparatus for Forming Via Holes in a Ceramic Green Sheet" by T. J. Cochran and R. G. Haas.

IBM Technical Disclosure Bulletin, vo. 26, No. 7A, Dec. 1983, "Punch Programmer with Magnetic Retract" by A. F. Coneski, P. J. Davies and F. B. Zykoff.

*Primary Examiner*—Frank T. Yost
*Assistant Examiner*—Kenneth E. Peterson
*Attorney, Agent, or Firm*—Richard Lau

[57] ABSTRACT

Punch apparatus develops momentum of a desired magnitude. The momentum is transferred to a punch for driving the punch from a reset position to a punch position.

8 Claims, 2 Drawing Sheets

PUNCH APPARATUS

RELATED U.S. APPLICATION DATA

This is a continuation application of Ser. No. 07/846,499, filed Feb. 25, 1992, abandoned.

TECHNICAL FIELD

This invention relates generally to electro-mechanical apparatus and, more particularly, to an electro-mechanical punch apparatus.

BACKGROUND OF THE INVENTION

Ceramic green-sheets are generally used in the manufacture of multilayer ceramic (MLC) substrates for integrated circuit packages. During the manufacturing process, via holes must be punched through these ceramic green-sheets. Typically, each ceramic green-sheet has a thickness of approximately 0.011 inches, the via holes are approximately 0.006 inches in diameter, and between approximately 20,000 and 200,000 or more via holes are required to be punched in each green-sheet.

In order to maintain adequate through-put in the manufacture of these integrated circuit packages, it is generally necessary to simultaneously punch a multitude of via holes through a green-sheet. In other words, a multitude of via holes must be punched at the same time. Such simultaneous punching requires the use of many closely positioned and simultaneously controlled punch mechanisms or apparatus. For example, the number of via holes that must be simultaneously punched at a given time can be on the order of approximately between 100–256, or more. Attempts to provide an adequate punching system have encountered many problems. These problems include high power requirements, substantial heat generation, high costs to produce and operate, cycle time requirements, punch velocity requirements, improper resetting of punch mechanisms, highly complex punch mechanisms, and reliability requirements.

Conventional punch mechanisms which have exhibited some or all of these problems in one form or another include solenoid-driven punches, punches utilizing motor driven eccentrics, and punches utilizing voice coil type actuators. Thus there remains a need for a punch apparatus which overcomes the above-listed problems associated with conventional punches.

SUMMARY OF THE INVENTION

Accordingly, it is an object of the present invention to provide a new and improved punch apparatus.

It is another object of the present invention to provide a punch apparatus which provides high punch velocity and fast punch cycle time while requiring minimal electrical power.

It is yet another object to provide a punch apparatus having relatively simple construction and ease of maintenance.

In order to accomplish the above and other objects of the invention, a punch apparatus is provided which includes momentum means for developing momentum of a desired magnitude, and punch means communicating with the momentum means such that momentum developed by the momentum means is transferred to the punch means so that the punch means is driven from a reset position to a punch position.

BRIEF DESCRIPTION OF THE DRAWINGS

These and other objects, features, aspects and advantages will be more readily apparent and better understood from the following detailed description of the invention, in which.

DETAILED DESCRIPTION OF THE PREFERRED EMBODIMENTS

Figure 1:
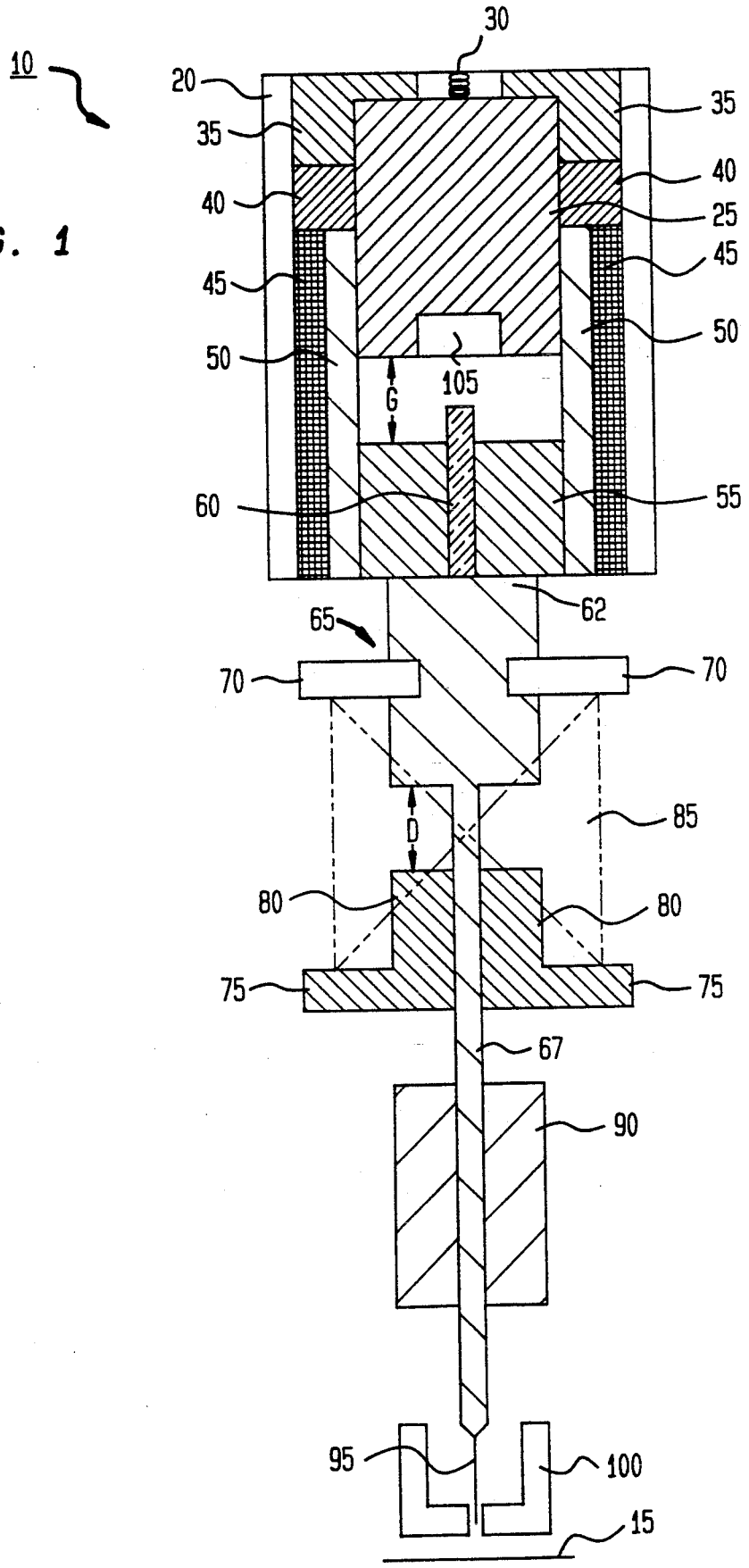
FIG. 1 shows a sectional view of a punch apparatus constructed in accordance with the present invention and in a reset or inactive position.
Figure 2:
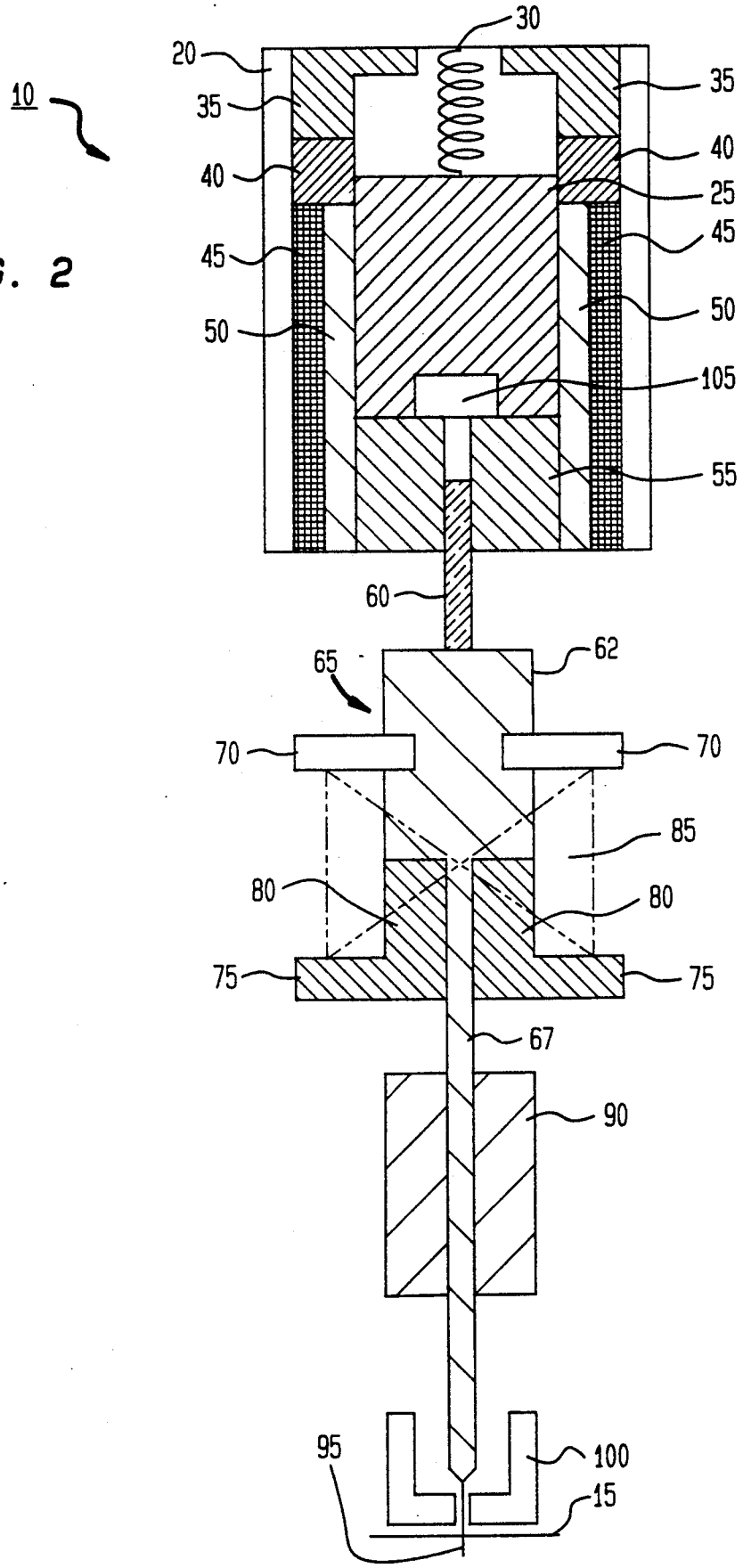
FIG. 2 is a view similar to FIG. 1 showing the punch apparatus in a punch or active position.

Referring to the Figures, there is shown a punch apparatus 10 constructed in accordance with the present invention. A sheet 15 is appropriately positioned for being punched by the punch apparatus 10. As an example, the sheet 15 may be a ceramic green-sheet of the type used in the manufacture of MLC substrates as described hereinabove in the BACKGROUND OF THE INVENTION. Moreover, the sheet 15 can also be representative of a plurality of sheets which are layered on top of one another. Particularly, FIG. 1 illustrates the punch apparatus 10 in a reset or retracted or inactive position, and FIG. 2 illustrates the punch apparatus 10 in a punch or active position.

The punch apparatus 10 includes means for developing momentum of a desired magnitude, which may be, for example, a solenoid 20 comprising a flat or conical face plunger 25 constructed of any magnetic iron, steel, or alloy thereof, or the like, a return spring 30, a plunger stop 35, a flux guide 40, a coil 45 wound around a bobbin 50, and a pole piece 55. Advantageously, for cost effectiveness and ease of construction, the solenoid may be a conventional tubular type electro-mechanical solenoid. The return spring 30 has one end affixed to the body of the solenoid, and has its other end affixed to the plunger 25 so as to maintain the plunger 25 in a reset position against the plunger stop 35. However, the plunger 25 can be maintained in the reset position by any suitable reset means, such as by using a magnet or electro-magnet. In the reset position, the plunger 25 is separated from the pole piece 55 by a gap G.

A drive rod 60 extends axially, and is disposed slidably and concentrically within a bore defined by the pole piece 55. In the reset position, the drive rod 60 has its upper end extending above the top surface of the pole piece 60 to within the gap G. Further, the lower end of the drive rod 60 is integrally connected to the top portion 62 of a punch 65. However, it should be understood that the drive rod 60 can also be separated from the punch 65. Further, the punch 65 has a retaining ring 70 mounted therearound which, in conjunction with extensions 75 of stop bushing 80, maintain a punch spring 85 in proper confinement therebetween. The punch spring 85 has a force which is adequate for maintaining the punch 65 in the reset position as shown in FIG. 1. Moreover, the punch 65 has a rod portion 67 which extends axially through and is guided by the stop bushing 80 and a guide bushing 90. At its lower end, the punch 65 terminates in a punch tip 95 which is guided by a punch guide 100 for ensuring accurate punching of the sheet 15. The top portion 62, rod portion 67 and punch tip 95 can each be constructed from the same or different material as desired. However, it should be understood that the punch tip 95 should be comprised of a material of appropriate hardness for punching or piercing the sheet 15; and the material should be abrasion resistant so that the tip 95 will not wear out due to the abrasiveness of the sheet 15. For example, the top portion 62 and rod portion 67 can each be comprised of stainless steel, and the punch tip 95 can be comprised of tungsten carbide for punching ceramic green-sheets.

In operation, the solenoid 20 is suitably energized with current from a current source (not shown) so that the plunger 25 overcomes the force of the return spring 30 and accelerates to a suitable velocity toward the pole piece 55, thus acquiring a momentum or kinetic energy of a desired suitable magnitude. The momentum or kinetic energy is determined by the mass and velocity of the plunger 25. Before the plunger 25 reaches or bottoms out at the pole piece 55, it strikes or impacts the drive rod 60. Preferably, the drive rod 60 has elastic properties so that the it will compress from the impact of the plunger 25 and absorb the kinetic energy from the plunger 25. Thus, the impact of the plunger 25 with the drive rod 60 results in a transfer of momentum or kinetic energy from the plunger 25 to the drive rod 60, causing a deceleration in the plunger 25 and a compressing of the drive rod 60. The drive rod 60 can be constructed of tungsten carbide, stainless steel, or other similar material.

Preferably, current is removed from the solenoid 20 before the plunger 25 reaches the pole piece 55, but after it strikes the drive rod 60; and it is desirable for the plunger 25 to be travelling at approximately zero velocity when it reaches or bottoms out at the pole piece 55. After current is removed from the solenoid 20 and the plunger 25 bottoms out at the pole piece 55, the return spring 30 forces the plunger 25 back to the reset position against the plunger stop 35.

In order to avoid and overcome wearing out of the plunger 25 due to its impacting of the drive rod 60, a material of sufficient hardness can be employed to form a replaceable insert 105 which is disposed in the plunger 25 at its point of impact with the drive rod 60. Of course, the type of material used to form such an insert 105 depends on the material used to form the drive rod 60, as the insert 105 should be at least as hard as the drive rod 60. For example, if the drive rod 60 is comprised of tungsten carbide, then the insert 105 can be comprised of tungsten carbide, or other material of equal or greater hardness.

After the kinetic energy of the plunger 25 is transferred to the drive rod 60, the compressed drive rod 60 rebounds and transfers the kinetic energy to the punch 65, thus driving the punch 65 toward the sheet 15. Preferably, in order to achieve a substantially complete transfer of kinetic energy from the plunger 25 to the punch 65 so as to allow the plunger 25 to decelerate to approximately zero velocity when it reaches the pole piece 55, the mass of the punch 65 should be substantially equal to the mass of the plunger 25.

As shown in FIG. 2, the transfer of kinetic energy to the punch 65 results in the punch 65 travelling toward the sheet 15 and the punch spring 85 compressing. Thus, ultimately, the tip 95 of the punch 65 punches through the sheet 15. Proper guiding of the punch 65 is provided by the stop bushing 80 and the guide bushing 90; and the punch tip 95 is guided by the punch guide 100 so that the sheet 15 can be accurately punched by the tip 95. Moreover, in order to ensure proper and consistent punching and to provide ease of maintenance, the tip 95 can be mounted to the rod portion 67 of the punch 65 in a replaceable manner.

It should be noted that the amount of kinetic energy required to be transferred to the punch 65 from the plunger 25 via the drive rod 60 is dependent upon many factors, including the material used to form the sheet 15 to be punched. In this regard, the required punch velocity for piercing a material is dependent upon the thickness of the material and the mass of the punch being used.

Moreover, it should also be taken into account that perfectly elastic collisions do not occur in macroscopic bodies. Accordingly, certain losses can be expected during the transfer of kinetic energy from the plunger 25 to the drive rod 60. In order to compensate for these losses, assuming that the plunger 25 has a mass which is approximately equal to the mass of the punch 65, a solenoid can be used in which the plunger 25 is capable of achieving velocities greater than the velocity required for the punch 65 to punch a hole in the sheet 15. For example, it has been found that utilizing a solenoid capable of achieving a plunger velocity approximately 2–3 times greater than the minimum velocity required for the punch to punch a hole in the sheet 15 is ample to compensate for losses and for punch return spring forces.

The distance that the punch 65 is permitted to travel toward the sheet 15 is limited by the stop bushing 80. More specifically, the impacting of the top portion 62 of the punch 65 against the stop bushing 80 limits the movement of the punch 65. Accordingly, the distance D between the top portion 62 and the stop bushing 80 must be adequate so as to allow the punch 65 to travel an appropriate distance so that its tip 95 can punch the sheet 15. After the top portion 62 impacts the stop bushing 80, the punch spring 85 forces the punch 65 and the drive rod 60 back to the reset position.

A punch apparatus constructed in accordance with the present invention has realized an extremely high punch velocity, on the order of 2–3 meters/second, and fast punching action, completing a single punch in about 5 ms. Further, the apparatus of the present invention allows for this punch velocity and fast punching action to be achieved using very little electrical power, about 1 watt per punch.

The present invention has specific application in the fabrication of semiconductor device packages and, more specifically, can be utilized in very large quantities in computer controlled punch systems for punching ceramic green-sheets to fabricate semiconductor device packages.

While the invention has been described in terms of specific embodiments, it is evident in view of the foregoing description that numerous alternatives, modifications and variations will be apparent to those skilled in the art. Thus, the invention is intended to encompass all such alternatives, modifications and variations which fall within the scope and spirit of the invention and the appended claims.

What is claimed is:

1. A punch apparatus, comprising:

a solenoid having a plunger and a pole piece, and being controllably energized for accelerating said plunger toward said pole piece from a first position to a second position for developing momentum of a desired magnitude;

drive means having elastic properties and being impacted by said plunger for absorbing momentum developed by said plunger, such that the momentum causes said drive means to compress; and a punch communicating with said drive means having a punch tip for punching material, said punch having a mass which is substantially equal to the mass of said plunger so that efficiency of energy usage is effectively maximized by allowing momentum absorbed by said drive means from said plunger to be substantially completely transferred to said punch so that said punch is driven from a reset position to a punch position so that the punch tip punches the material, said solenoid being de-energized subsequent to impact between said plunger and said drive means and prior to contact between said plunger and said pole piece, said plunger decelerating to near-zero velocity upon impact with said drive means so that impact force between said plunger and said pole piece is minimized.

2. A punch apparatus according to claim 1, wherein said plunger has an impact point comprising a replaceable insert which strikes said punch so as to transfer momentum to said punch.

3. A punch apparatus according to claim 1, wherein said drive means comprises a drive rod.

4. A punch apparatus according to claim 1, further comprising reset means for returning said punch to said reset position subsequent to being driven to said punch position.

5. A punch apparatus according to claim 4, wherein said reset means comprises spring means.

6. A punch apparatus according to claim 1, further comprising a punch tip guide for guiding the punch tip to the material as the punch is driven from the reset position to the punch position for ensuring accurate punching of the material.

7. A punch apparatus according to claim 1, further including reset means for returning said plunger to said first position subsequent to accelerating to said second position.

8. A punch apparatus according to claim 7, wherein said reset means comprises a spring.

* * * * *